US008684260B2

(12) United States Patent
White et al.

(10) Patent No.: US 8,684,260 B2
(45) Date of Patent: Apr. 1, 2014

(54) PAPERBOARD PLATE WITH CORNER WALLS

(75) Inventors: Joel P. White, Canal Winchester, OH (US); David J. Bulcher, Powell, OH (US); David C. Schiltz, Columbus, OH (US)

(73) Assignee: Reynolds Consumer Products Inc., Lake Forest, IL (US)

( * ) Notice: Subject to any disclaimer, the term of this patent is extended or adjusted under 35 U.S.C. 154(b) by 461 days.

(21) Appl. No.: 13/078,335

(22) Filed: Apr. 1, 2011

(65) Prior Publication Data

US 2012/0248180 A1 Oct. 4, 2012

(51) Int. Cl.
*B65D 1/34* (2006.01)
*B65D 1/40* (2006.01)

(52) U.S. Cl.
USPC ..... 229/407; 220/574

(58) Field of Classification Search
USPC ..... 229/406, 407; 220/574, 575, 656, 657, 220/658; D7/545, 554.1, 554.3, 554.4, 586
See application file for complete search history.

(56) References Cited

U.S. PATENT DOCUMENTS 2,911,320 A 11/1959 Phillips et al.
3,938,727 A 2/1976 Andersson
3,963,843 A 6/1976 Hitchmough et al.
4,078,924 A 3/1978 Keddie et al.
4,238,533 A 12/1980 Pujol et al.
4,247,038 A * 1/1981 Forbes, Jr. ..... 229/108
4,503,096 A 3/1985 Specht
4,533,065 A * 8/1985 Chazal et al. ..... 229/109
4,567,099 A 1/1986 Van Gilder et al.
4,606,496 A 8/1986 Marx et al.
4,609,140 A 9/1986 Van Handel et al.
4,609,704 A 9/1986 Hausman et al.
4,721,499 A 1/1988 Marx et al.
4,721,500 A 1/1988 Van Handel et al.
4,781,566 A 11/1988 Rossi et al.
4,832,676 A 5/1989 Johns et al.
4,898,752 A 2/1990 Cavagna et al.
4,948,635 A 8/1990 Iwasaki
4,997,682 A 3/1991 Coco
5,033,373 A 7/1991 Brendel et al.
5,049,420 A 9/1991 Simons
5,088,640 A 2/1992 Littlejohn
5,169,715 A 12/1992 Maubert et al.
5,203,491 A 4/1993 Marx et al.
5,249,946 A 10/1993 Marx
5,323,956 A 6/1994 Marcontell
5,326,020 A 7/1994 Cheshire et al.
5,326,021 A * 7/1994 Farrell et al. ..... 229/109

(Continued)

OTHER PUBLICATIONS

International Search Report and Written Opinion for PCT/US2011/049943, dated Dec. 2, 2011.

*Primary Examiner* — Gary Elkins
*Assistant Examiner* — Phillip Schmidt
(74) *Attorney, Agent, or Firm* — Baker Botts L.L.P.

(57) ABSTRACT

Paperboard plate includes a base having a substantially smooth flat surface, a plurality of side walls extending upwardly from the base, and a plurality of corner walls. Each side wall and each corner wall has a substantially straight upper edge. Each corner wall is disposed between a pair of adjacent side walls. The length of the upper edge of each corner wall is less than the length of the upper edge of each side wall. Furthermore, each side wall can include a lower portion and an upper portion at different angles relative each other.

21 Claims, 16 Drawing Sheets

(56) References Cited

U.S. PATENT DOCUMENTS

| | | | | | |
|---|---|---|---|---|---|
| 5,334,449 | A | | 8/1994 | Bergmann et al. | |
| 5,340,611 | A | | 8/1994 | Kustermann et al. | |
| 5,356,070 | A | * | 10/1994 | Rigby | 229/120.17 |
| 5,603,996 | A | | 2/1997 | Overcash et al. | |
| 5,609,686 | A | | 3/1997 | Jerry et al. | |
| 5,758,773 | A | * | 6/1998 | Clements | 206/519 |
| 5,770,303 | A | | 6/1998 | Weinert et al. | |
| 5,776,619 | A | | 7/1998 | Shanton | |
| 5,795,923 | A | | 8/1998 | Shahid | |
| 5,830,548 | A | | 11/1998 | Andersen et al. | |
| 5,852,166 | A | | 12/1998 | Gruber et al. | |
| 5,869,567 | A | | 2/1999 | Fujita et al. | |
| 5,932,651 | A | | 8/1999 | Liles et al. | |
| 5,938,112 | A | | 8/1999 | Sandstrom | |
| 5,972,167 | A | | 10/1999 | Hayasaka et al. | |
| 5,981,011 | A | | 11/1999 | Overcash et al. | |
| 5,984,130 | A | | 11/1999 | Hayes et al. | |
| D434,277 | S | | 11/2000 | Martel | |
| 6,715,630 | B2 | | 4/2004 | Littlejohn et al. | |
| 7,048,176 | B2 | | 5/2006 | Littlejohn et al. | |
| D541,589 | S | | 5/2007 | Littlejohn | |
| 7,540,833 | B2 | | 6/2009 | Johns et al. | |
| D617,143 | S | * | 6/2010 | Cole et al. | D7/396.1 |
| 2006/0208054 | A1 | * | 9/2006 | Littlejohn et al. | 229/406 |
| 2007/0215678 | A1 | | 9/2007 | Swoboda et al. | |
| 2009/0114659 | A1 | * | 5/2009 | Littlejohn | 220/660 |

* cited by examiner

PAPERBOARD PLATE WITH CORNER WALLS

BACKGROUND OF THE INVENTION

1. Field of the Invention

The present application relates to a paperboard plate having a plurality of side walls and a plurality of corner walls.

2. Description of Related Art

Consumers desire a receptacle for foodstuff that is inexpensive and disposable, yet provides properties comparable to more costly nondisposable receptacles for foodstuff. Manufacturers are challenged to produce a disposable receptacle with properties acceptable to consumers at lower costs. Specifically, consumers desire and manufactures seek to provide disposable foodstuff receptacles having sufficient rigidity to support foodstuff held therein at the lowest cost possible.

Conventional paperboard plates are made from a suitable feedstock material by way of a variety of processes employing many types of equipment. Such materials, techniques and equipment are well known to those of skill in the art.

Paper disposable food containers may be made by way of pulp-molding processes or by way of pressing a planar paperboard container blank in a matched metal heated die set. Pressed paperboard containers may be made as noted in one or more of U.S. Pat. No. 4,606,496 entitled "Rigid Paperboard Container" of R. P. Marx et al; U.S. Pat. No. 4,609,140 entitled "Rigid Paperboard Container and Method and Apparatus for Producing Same" of G. J. Van Handel et al.; U.S. Pat. No. 4,721,499 entitled "Method of Producing a Rigid Paperboard Container" of R. P. Marx et al.; U.S. Pat. No. 4,721,500 entitled "Method of Forming a Rigid Paper-Board Container" of G. J. Van Handel et al.; and U.S. Pat. No. 5,203,491 entitled "Bake-in Pres-Formed Container" of R. P. Marx et al. Equipment and methods for making paperboard containers are also disclosed in U.S. Pat. No. 4,781,566 entitled "Apparatus and Related Method for Aligning Irregular Blanks Relative to a Die Half" of A. F. Rossi et al.; U.S. Pat. No. 4,832,676 entitled "Method and Apparatus for Forming Paperboard Containers" of A. D. Johns et al.; and U.S. Pat. No. 5,249,946 entitled "Plate Forming Die Set" of R. P. Marx et al. The forming section may include a plurality of reciprocating upper die halves opposing, in facing relationship, a plurality of lower die halves. The upper die halves are mounted for reciprocating movement in a direction that is oblique or inclined with respect to the vertical plane. The paperboard blanks, after cutting, are gravity fed to the inclined lower die halves in the forming section. The construction of the die halves and the equipment on which they are mounted may be substantially conventional; for example, as utilized on presses manufactured by the Peerless Manufacturing Company. For paperboard plates stock of conventional thicknesses, i.e., in the range of from about 0.010 to about 0.040 inches, it is preferred that the spacing between the upper die surface and the lower die surface decline continuously from the nominal paperboard thickness at the center to a lower value at the rim.

The paperboard which is formed into the blanks is conventionally produced by a wet laid paper making process and is typically available in the form of a continuous web on a roll. The paperboard stock is preferred to have a basis weight in the range of from about 100 pounds to about 400 pounds per 3000 square foot ream and a thickness or caliper in the range of from about 0.010 to about 0.040 inches as noted above. Lower basis weights and caliper paperboard is preferred for ease of forming and realizing savings in feedstock costs. Paperboard stock utilized for forming paper plates is typically formed from bleached pulp furnish, and is usually impregnated with starch and double clay coated on one side as is further discussed herein.

In a typical forming operation, the web of paperboard stock is fed continuously from a roll through a cutting die to form circular blanks which are then fed into position between the upper and lower die halves. The die halves are heated to aid in the forming process. It has been found that best results are obtained if the upper die half and lower die half—particularly the surfaces thereof—are generally maintained at a temperature in the range of from about 250 degrees F. to about 400 degrees F. These die temperatures have been found to facilitate the plastic deformation of paperboard in the rim areas if the paperboard has the preferred moisture levels. At these preferred die temperatures, the amount of heat applied to the blank is sufficient to liberate the moisture within the blank and thereby facilitate the deformation of the fibers without overheating the blank and causing blisters from liberation of steam or scorching the blank material. It is apparent that the amount of heat applied to the paperboard will vary with the amount of time that the dies dwell in a position pressing the paperboard together. The preferred die temperatures are based on the usual dwell times encountered for normal plate production speeds of 40 to 60 pressings a minute, and commensurately higher or lower temperatures in the dies would generally be required for higher or lower production speeds, respectively.

Paperboard for disposable pressware typically includes a coating. Illustrative in this regard are U.S. Pat. No. 5,776,619 ("the '619 patent") to Shanton and U.S. Pat. No. 5,603,996 ("the '996 patent") to Overcash et al. The '619 patent discloses plate stock provided with a base coat which includes a styrene-acrylic polymer as well as a clay filler as a base coat as well as a top coat including another styrene acrylic polymer and another clay filler. The use of fillers is common in the art as may be seen in the '996 patent to Overcash et al. In the '996 patent a polyvinyl alcohol polymer is used together with an acrylic emulsion as well as a clay to form a barrier coating for a paperboard oven container. See Column 12, lines 50 and following. Indeed, various coatings for paper form the subject matter of many patents including the following: U.S. Pat. No. 5,981,011 to Overcash et al.; U.S. Pat. No. 5,334,449 to Bergmann et al.; U.S. Pat. No. 5,169,715 to Maubert et al.; U.S. Pat. No. 5,972,167 to Hayasaka et al.; U.S. Pat. No. 5,932,651 to Liles et al.; U.S. Pat. No. 5,869,567 to Fujita et al.; U.S. Pat. No. 5,852,166 to Gruber et al.; U.S. Pat. No. 5,830,548 to Andersen et al.; U.S. Pat. No. 5,795,923 to Janssen et al.; U.S. Pat. No. 5,770,303 to Weinert et al.; U.S. Pat. No. 4,997,682 to Coco; U.S. Pat. No. 4,609,704 to Hausman et al.; U.S. Pat. No. 4,567,099 to Van Gilder et al.; and U.S. Pat. No. 3,963,843 to Hitchmough et al.

Various methods of applying aqueous polymer coatings and smoothing them are known in the art. See U.S. Pat. No. 2,911,320 to Phillips; U.S. Pat. No. 4,078,924 to Keddie et al.; U.S. Pat. No. 4,238,533 to Pujol et al.; U.S. Pat. No. 4,503,096 to Specht; U.S. Pat. No. 4,898,752 to Cavagna et al.; U.S. Pat. No. 5,033,373 to Brendel et al.; U.S. Pat. No. 5,049,420 to Simons; U.S. Pat. No. 5,340,611 to Kustermann et al.; U.S. Pat. No. 5,609,686 to Jerry et al.; and U.S. Pat. No. 4,948,635 to Iwasaki.

Configurations for disposable food containers have been improved over the years. One configuration is shown in U.S. Pat. No. 5,088,640 ("the '640 patent") to Littlejohn. The '640 patent discloses a disposable plate provided with a smooth outer profile which defines four radii of curvature subtending arcs of the outer portions of the plate. The various radii are selected for enhancing rigidity of the pressed paper plate as compared to other conventional designs made from the same paperboard stock. The flowing arcuate design of the '640 patent identifies additional advantages, notably with respect to manufacture. The '640 patent notes that it is possible to achieve high press speeds, exercise pleating control and maintain product consistency, even when product is formed slightly off-center due to the forgiving tolerances inherent in the design.

Another configuration for pressed paperboard food containers is disclosed in U.S. Pat. No. 5,326,020 ("the '020 patent") to Chesire et al, The '020 patent discloses a pressed paper plate having three frustoconical or linear profiled regions about its sidewall and rim. The sidewall region includes a generally annular region flaring upwardly and outwardly from a periphery of a planar inner region and a first frustoconical, linear profiled region adjoining the annular region with the frustoconical region sloping outwardly and upwardly from the annular region. The rim region includes an outwardly flaring arcuate annular region adjoining an outer periphery of the first frustoconical region, and a second frustoconical region extending generally tangentially from the arcuate annular region. The second frustoconical or linear profiled region extends outwardly and downwardly at an angle of about 6 degrees to about 12 degrees and preferably about 6 degrees to 10.5 degrees relative to the plane defined by the planar inner region. The rim of the container further includes an outwardly and downwardly flaring frustoconical lip with a linear profile adjoining an outer periphery of the second frustoconical region in order to aid in grasping of the paperboard container by the consumer. Additionally, a plurality of radially extending mutually spaced pleats are also formed in the rim region and are internally bonded with portions of the rim region during formation of the paperboard container by a die press. Pressed paperboard containers configured in accordance with the '020 patent are capable of exhibiting very high rigidity.

Manufacturers have historically enhanced the rigidity of such circular geometry plates by increasing the thickness of the paperboard material used in such circular plates. However, increasing the thickness of the paperboard material also increases the amount of material required during manufacturing and leads to higher costs for each plate.

Therefore, there is a need for a paperboard plate with high rigidity that does not significantly increase the manufacturing costs of each plate.

SUMMARY OF THE INVENTION

The purpose and advantages of the present application will be set forth in and apparent from the description that follows, as well as will be learned by practice of the disclosed subject matter. Additional advantages of the disclosed subject matter will be realized and attained by the apparatus particularly pointed out in the written description and claims hereof, as well as from the appended drawings.

To achieve these and other advantages and in accordance with the purpose of the application, as embodied and broadly described, the disclosed subject matter includes a paperboard plate having a base, a plurality of side walls, and a plurality of corner walls. The base can include, but is not limited to, a substantially smooth flat surface having an overall base length BL and an overall base width BW. The plurality of side walls extend upwardly from the planar base. Each side wall can include, but is not limited to, a substantially straight upper edge at a height V4 from the base. The height V4 is less than about 0.20 times the base length BL. The plurality of corner walls extend upwardly from the planar base. Each corner wall is disposed between a pair of adjacent side walls and can include, but is not limited to, a substantially straight upper edge at the height V4 from the base. The upper edge of each side wall has a side wall upper edge length SWL. If base length BL is different than base width BW, the sidewall upper edge length SWL along base length BL can be different from sidewall upper edge length SWL along base width BW, accordingly. The upper edge of each corner wall has a corner wall upper edge length CWL, which is less than each side wall length SWL.

The disclosed subject matter can be a plate, but it is not limited to a plate, and can be made from a variety of known and suitable paperboard, such as, but not limited to, clay coated solid bleached sulfate, uncoated solid bleached sulfate, unbleached solid sulfate, bleached polymer coated paperboard, and unbleached polymer coated paperboard. The plate can be made from a variety of known and suitable manufacture techniques, including, but not limited to, manufacturing techniques that have a matched male and female forming surface and can be opened or closed by means of electrical, pneumatic, hydraulic, or mechanical action. The plate of the this disclosed subject matter has a generally rectangular shape with angled corners, and can have a variety of dimensions as suitable for intended purpose.

In accordance with one embodiment of the disclosed subject matter, the base length BL is substantially equal to the base width BW. Additionally or alternatively, the base can include a crowned center portion. The crowned center portion has a height up to about 0.05 times the greater of the base length BL and the base width BW.

An interface is defined between the base and each side wall. The interface has a cross-section with a radius of curvature between about 0.01 and 0.15 times the base length BL. Each side wall forms an overall resultant angle A3 with a line normal to the base. A sine of the resultant angle A3 is greater than about 0.05 times the base length BL.

A flange extends from the upper edge of each side wall. The flange has an outer edge opposite the upper edge of each side wall. An outer top length OTL is defined between the outer edge of the flange on opposing side walls along the base length BL. The upper edge of each side wall and the flange extending there from define an interface there between. The interface there between the upper edge of each side wall and the flange extending there from has a cross-section with a radius of curvature between about 0.001 and 0.05 times the outer top length OTL. The flange includes a turndown portion along a central interface, the turndown portion extending from the central interface to the outer edge of the flange. The turndown portion extends below the height V4 of the upper edge a vertical distance V3 greater than about 0.001 times the outer top length OTL. The width F1 of the flange between the upper edge of the side wall and the central interface is less than about 0.1 times the outer top length OTL. The central interface of the flange has a cross-section with a radius of curvature R4 between about 0.001 and 0.050 times the outer top length OTL.

Each corner wall upper edge length CWL embodied herein is between about 0.04 and 0.41 times the OTL. A flange extends from the upper edge of each corner wall. The flange extending from each corner wall has an outer edge opposite the upper edge of each corner wall. The outer edge of the flange extending from each corner wall transitions to the outer edge of the flange of an adjacent side wall along a radius R5 between about 0.04 and 0.67 times the corner wall upper edge length CWL.

In accordance with another embodiment, each side wall of the paperboard plate can comprise a lower portion and an upper portion, although each side wall is not limited to and may include three or more portions. For example, and as embodied herein, the lower portion of each side wall is substantially planar and forms a first angle A1 with a line normal to the base. A sine of the first angle A1 is greater than about 0.05 times the base length BL. The upper portion of each side wall is substantially planar and forms a second angle A2 with a plane substantially parallel to the lower portion of each side wall. A sine of the second angle A2 is greater than about 0.009 times the planar base length BL.

An inner top length ITL is defined between the upper edges of opposing side walls along the base length BL. The lower portion and the upper portion of each side wall define an interface therebetween. The interface there between the lower portion and the upper portion of each side wall has a cross-section with a radius of curvature between about 0.001 and 0.05 times the inner top length ITL.

The lower portion of each side wall extends from the planar base a height V1 above the base. The upper portion of each side wall extends from the interface between the lower portion and the upper portion a distance V2 which can be from about 0.1 up to about 1.0 times the height V4. The distances V1 and V2 sum to equal the height V4.

It is to be understood that both the foregoing general description and the following detailed description are exemplary and are intended to provide further explanation of the application claimed.

The accompanying drawings, which are incorporated in and constitute part of this specification, are included to illustrate and provide a further understanding of the apparatus of the application. Together with the written description, the drawings serve to explain the principles of the application.

BRIEF DESCRIPTION OF THE DRAWINGS

FIG. 18 is an enlarged diagrammatic top view of a corner of the paperboard plate shown in FIG. 10 to depict certain distances.

DETAILED DESCRIPTION OF THE PREFERRED EMBODIMENT

Reference will now be made in detail to the present preferred embodiments of the disclosed subject matter, examples of which are illustrated in the accompanying drawings. The paperboard plates presented herein generally are intended for providing a rigid and low cost means for containing foodstuffs, although other similar or suitable uses are contemplated.

In accordance with the disclosed subject matter, a paperboard plate is provided. The paperboard plate includes a base, a plurality of side walls, and a plurality of corner walls. The planar base has a substantially smooth flat surface. The plurality of side walls extend upwardly from the planar base. Each side wall has a substantially straight upper edge. The plurality of corner walls extend upwardly from the planar base. Each side wall is disposed between a pair of adjacent side walls. Further, each side wall has a substantially straight upper edge. The upper edge of each corner wall has a corner wall edge length less than a side wall edge length of the upper edge of each side wall.

For purpose of explanation and illustration, and not limitation, an exemplary embodiment of the paperboard plate in accordance with the application is shown in FIGS. 1 through 9.

Figure 1:
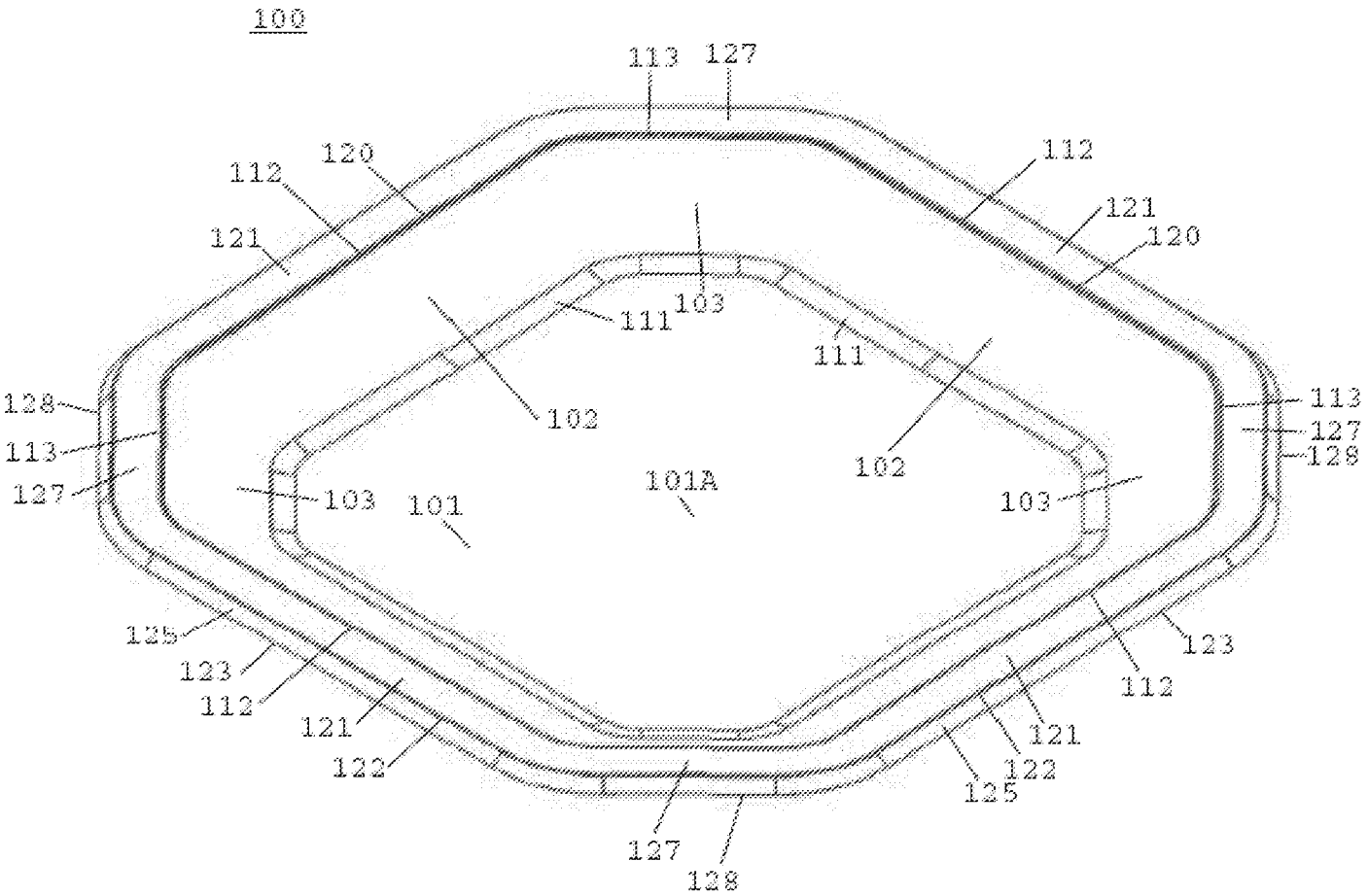
FIG. 1 is a perspective view of a representative embodiment of a paperboard plate in accordance with the disclosed subject matter.
Figure 2:
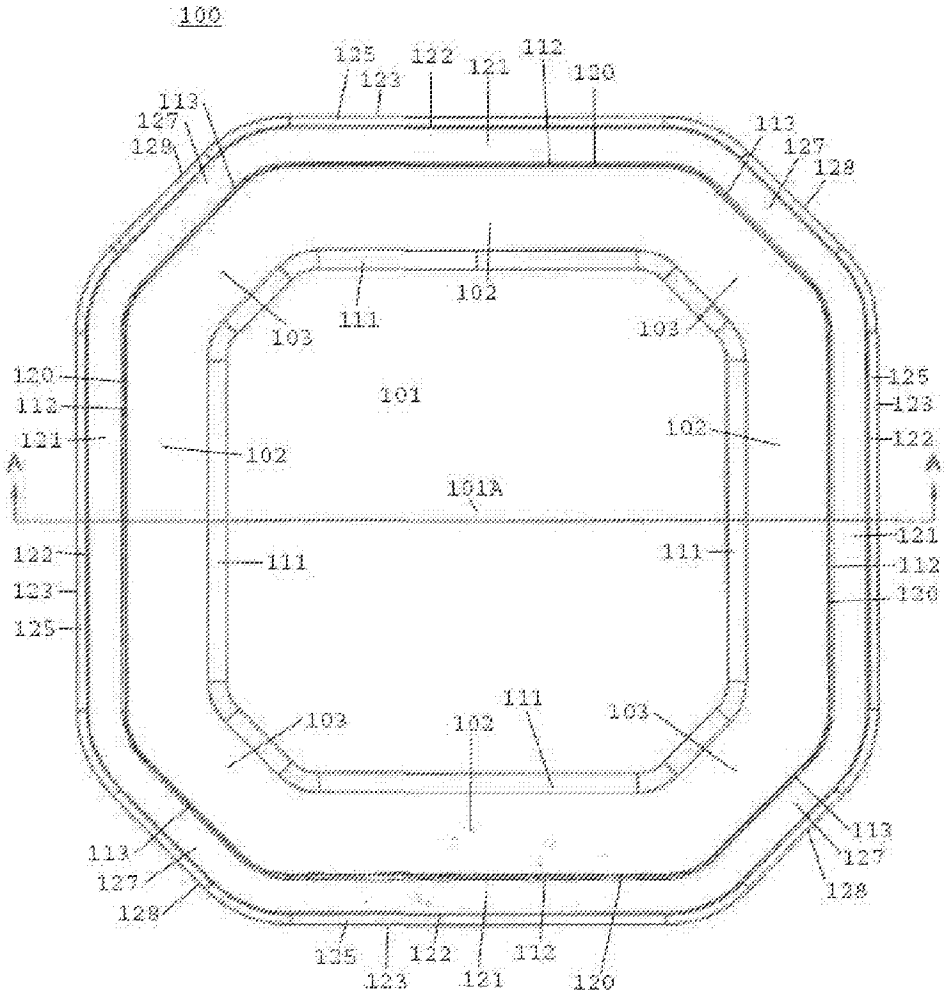
FIG. 2 is a top view of the paperboard plate shown in FIG. 1.
Figure 3:
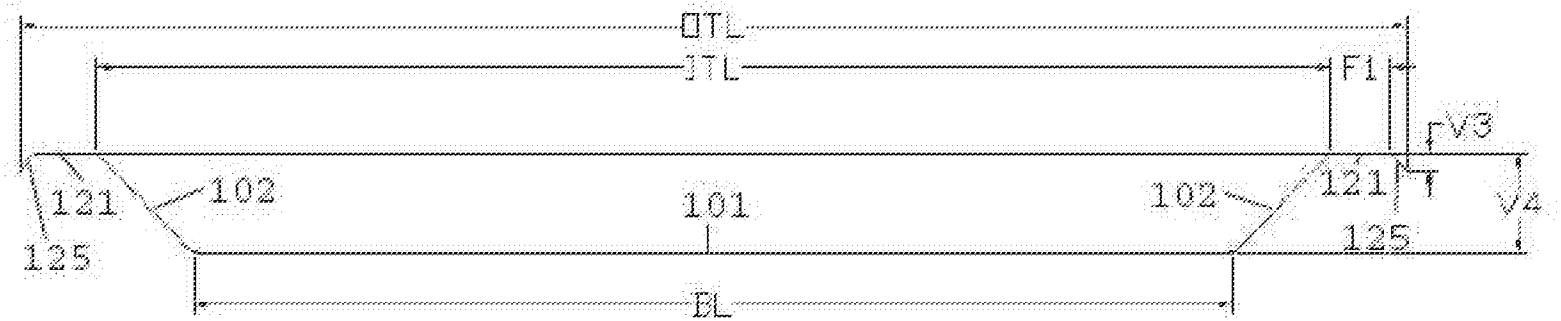
FIG. 3 is a diagrammatic sectional side view of the paperboard plate along the line A-A in FIG. 2.
Figure 4:
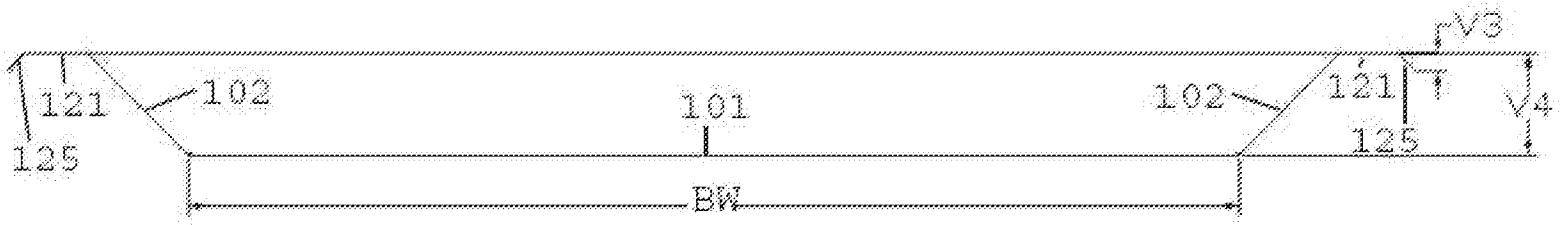
FIG. 4 is a diagrammatic sectional side view of the paperboard plate along a line perpendicular to the line A-A shown in FIG. 2.
Figure 5:
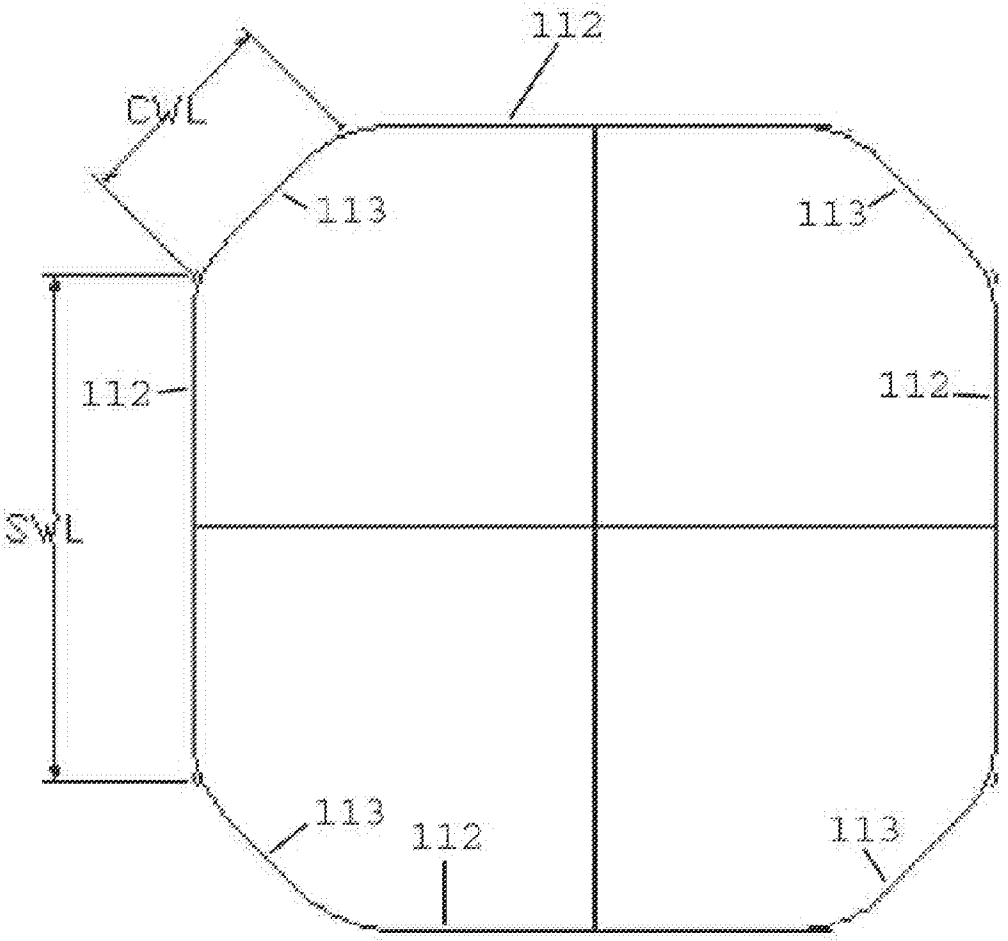
FIG. 5 is a diagrammatic top view of the paperboard plate shown in FIG. 1 to depict side wall upper edges and corner wall upper edges.

With reference to FIGS. 1 through 9, the paperboard plate 100 includes a base 101, a plurality of side walls 102, and a plurality of corner walls 103. The base 101 is a substantially smooth flat surface having an overall base length BL and an overall base width BW as shown in FIGS. 3 and 4. The plurality of side walls 102 extend upwardly from the base. Each side wall includes a substantially straight upper edge 112 at a height V4 from the base. The height V4 is less than about 0.20 times the base length BL. The plurality of corner walls 103 extend upwardly from the base 101. Each corner wall 103 is disposed between a pair of adjacent side walls 102 and includes a substantially straight upper edge 113 at the height V4 from the base, as illustrated in FIGS. 1 and 2. The upper edge 112 of each side wall 102 has a side wall upper edge length SWL, as shown in FIG. 5. The upper edge 113 of each corner wall 103 has a corner wall upper edge length CWL, also shown in FIG. 5. The corner wall upper edge length CWL is less than each side wall length SWL.

In accordance with one embodiment of the disclosed subject matter, the base length BL is substantially equal to the base width BW. As such, the side wall upper edge length SWL along base length BL generally will be equal to the side wall upper edge length SWL along base width BW. It is noted that if base length BL is different than base width BW, such as for a rectangular shape, the sidewall upper edge length SWL along base length BL will be different from sidewall upper edge length SWL along base width BW, accordingly. Additionally or alternatively, the base 101 can include a crowned center portion 101A, as shown in FIGS. 1 and 2. The crowned center portion has a height up to about 0.05 times the greater of the base length BL or the base width BW.

Figure 7:
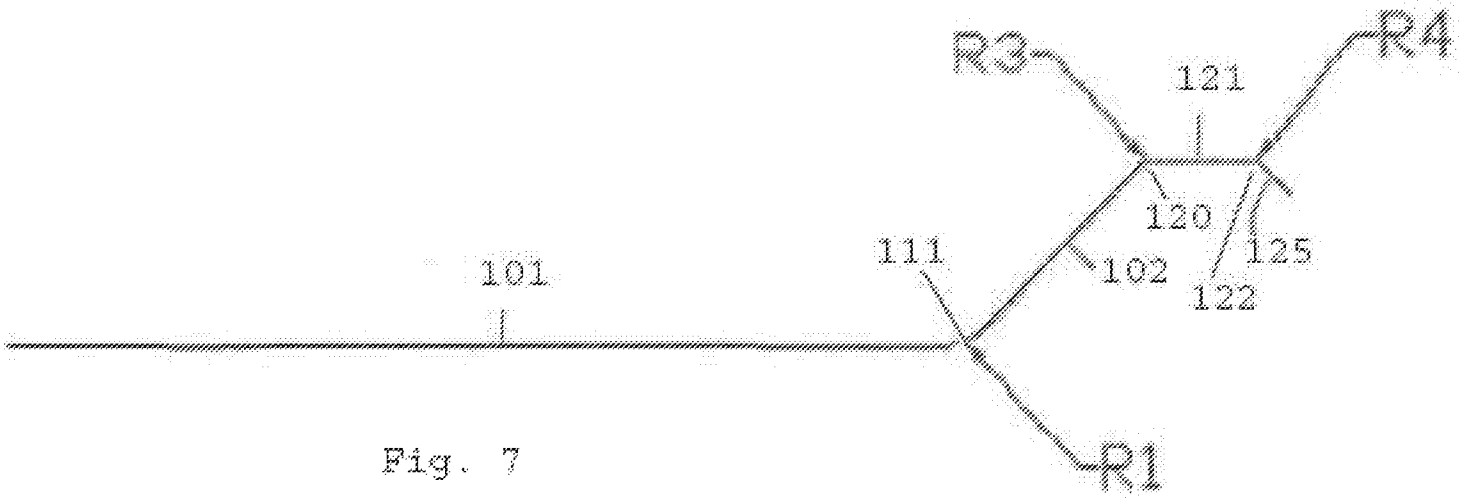
FIG. 7 is an enlarged diagrammatic sectional side view of a portion of the paperboard plate along the line A-A shown in FIG. 2 to depict various radii of curvature.
Figure 8:
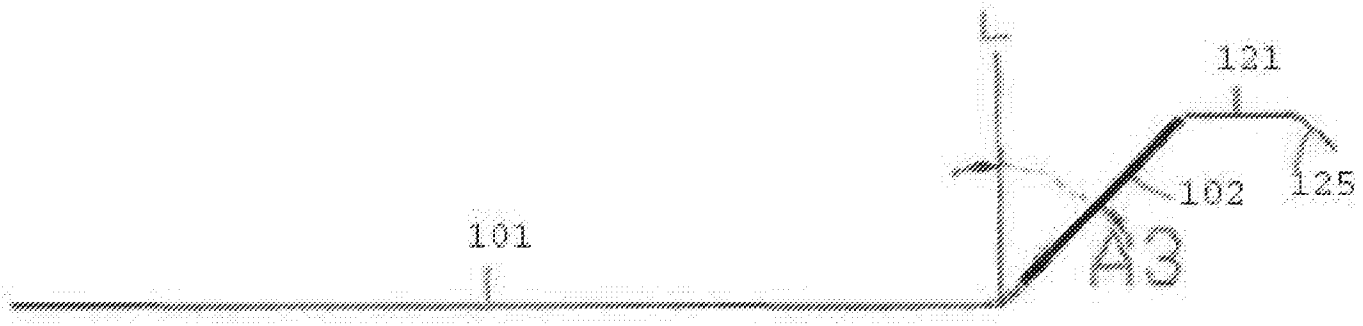
FIG. 8 is an enlarged diagrammatic sectional side view of a portion of the paperboard plate along the line A-A shown in FIG. 2 to depict various angles of the side wall.

An interface 111 is defined between the base 101 and each side wall 102. The interface 111 has a cross-section with a radius of curvature R1 between about 0.01 and 0.15 times the base length BL, as shown in FIG. 7. Each side wall 102 forms an overall resultant angle A3 with a line L normal to the base 101 as shown in FIG. 8. A sine of the resultant angle A3 is greater than about 0.05 times the base length BL.

Figure 6:
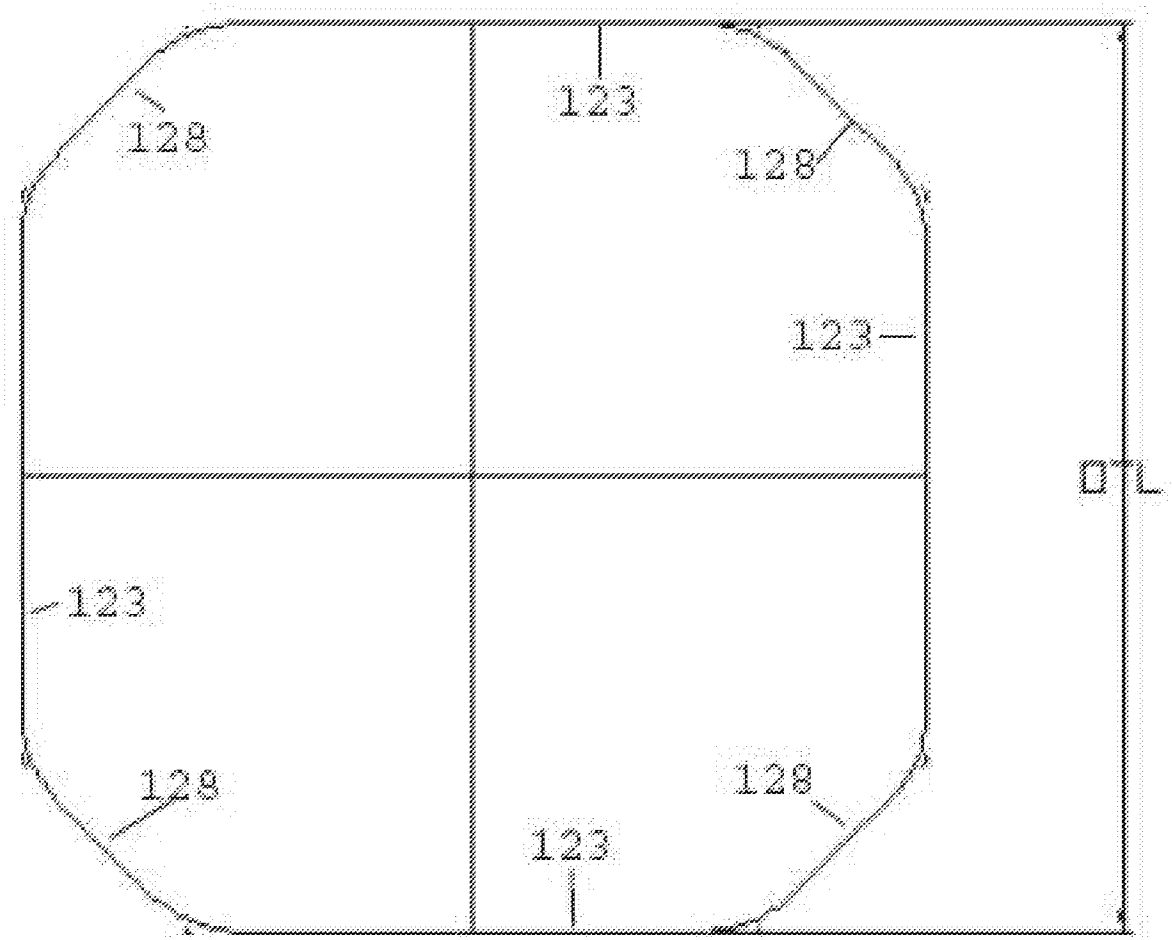
FIG. 6 is a diagrammatic top view of the paperboard plate shown in FIG. 1 to depict the outer perimeter of the paperboard plate.

A flange 121 extends from the upper edge 112 of each side wall 102, as illustrated in FIGS. 1 and 2. The flange 121 has an outer edge 123 opposite the upper edge 112 of each side wall 102. An outer top length OTL is defined between the outer edge 123 of the flange 121 on opposing side walls 112 along the base length BL as shown in FIG. 6. The upper edge 112 of each side wall 102 and the flange 121 extending therefrom define an interface 120 therebetween. The interface 120 between the upper edge 112 of each side wall 102 and the flange 121 extending therefrom has a cross-section with a radius of curvature R3 between about 0.001 and 0.05 times the outer top length OTL as shown in FIG. 7. The flange 121 includes a turndown portion 125 along a central interface 122 thereof, wherein turndown portion 125 extends from central interface 122 to outer edge 123 of flange 121, as illustrated in FIGS. 1 and 2. The turndown portion 125 extends below the height V4 of the upper edge 112 a vertical distance V3 greater than about 0.001 times the outer top length OTL as shown in FIG. 3. The width F1 of flange 121 between upper edge 112 of side wall 102 and central interface 122 is less than about 0.1 times the outer top length OTL. The central interface 122 of the flange 121 has a cross-section with a radius of curvature R4 between about 0.001 and 0.050 times the outer top length OTL, as shown in FIG. 7.

Figure 9:
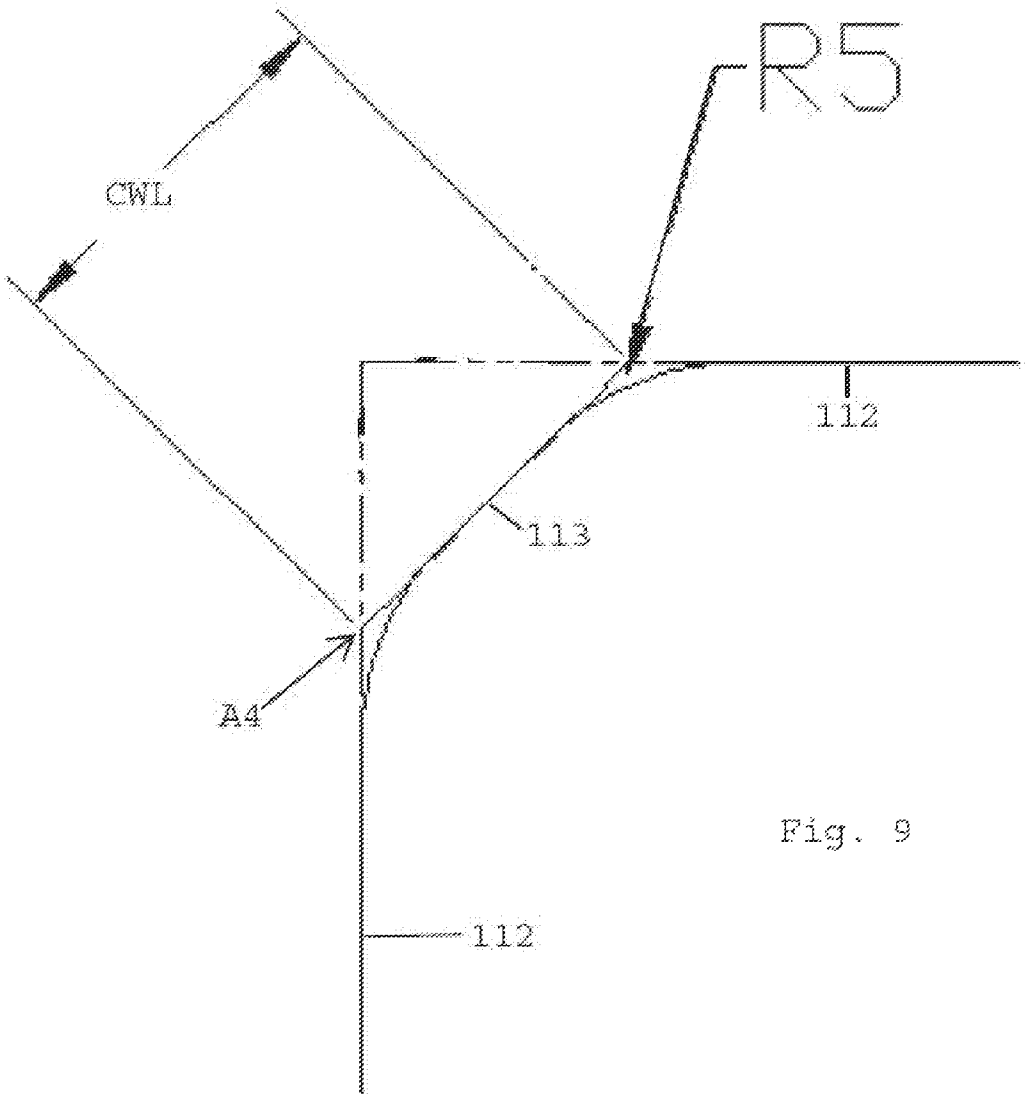
FIG. 9 is an enlarged diagrammatic top view of a corner of the paperboard plate shown in FIG. 1 to depict certain distances.

Each corner wall upper edge length CWL is between about 0.04 and 0.41 times the OTL. A flange 127 extends from the upper edge 113 of each corner wall 103, as illustrated in FIGS. 1 and 2. The flange 127 extending from each corner wall 103 has an outer edge 128 opposite the upper edge 113 of each corner wall 103. The outer edge 128 of the flange 127 extending from each corner wall 103 transitions to the outer edge 123 of the flange 121 of an adjacent side wall along a radius R5 between about 0.04 and 0.67 times the corner wall upper edge length CWL, as shown in FIG. 9.

Figure 10:
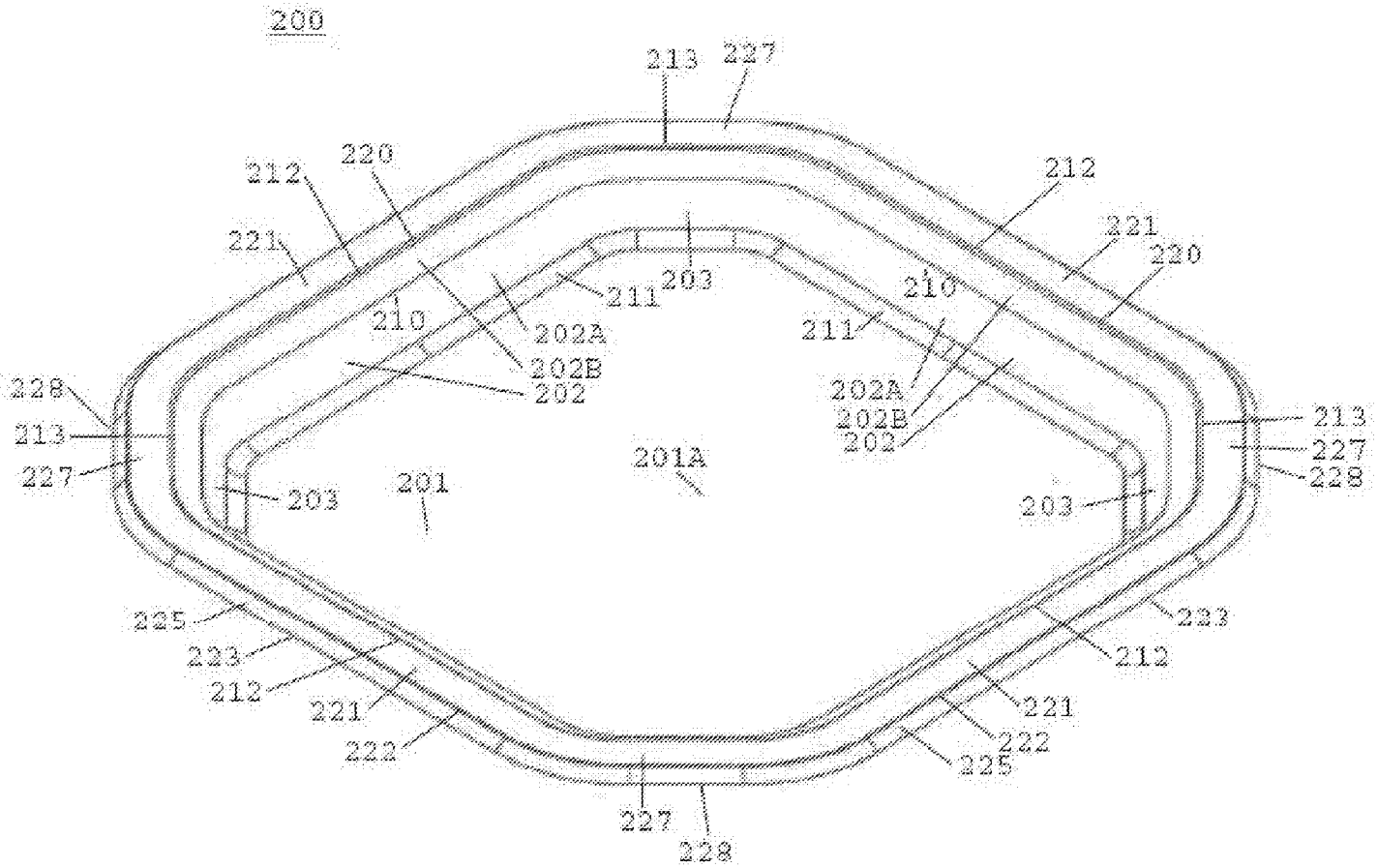
FIG. 10 is a perspective view of an another representative embodiment of a paperboard plate in accordance with the disclosed subject matter.
Figure 11:
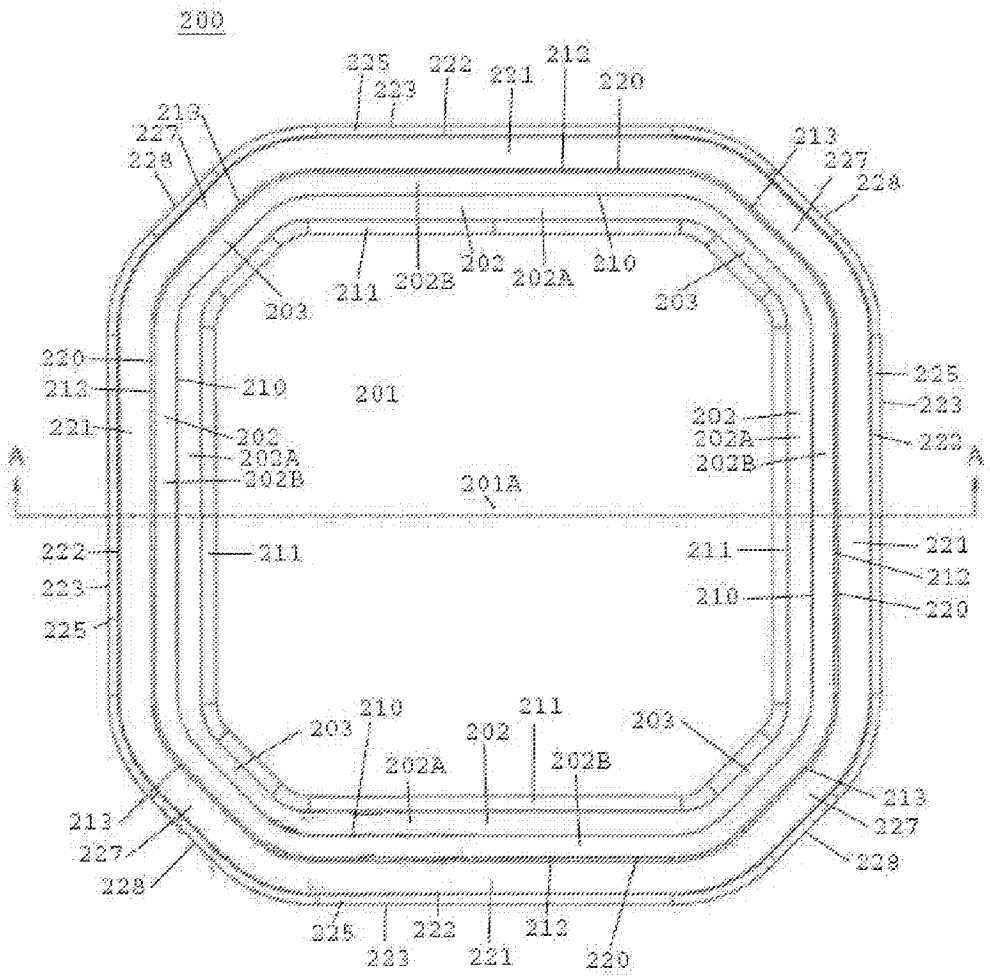
FIG. 11 is a top view of the paperboard plate shown in FIG. 10.
Figure 12:
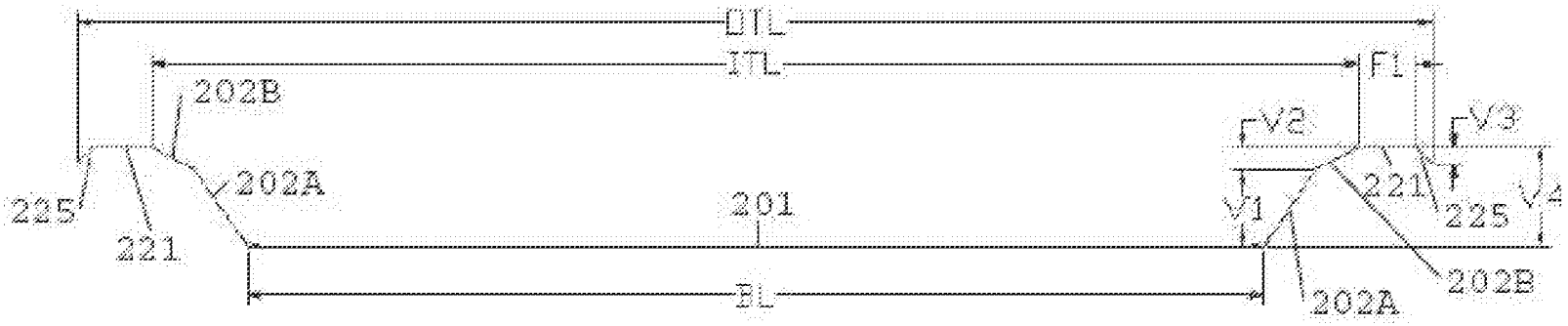
FIG. 12 is a diagrammatic sectional side view of the paperboard plate along the line A-A in FIG. 11.
Figure 13:
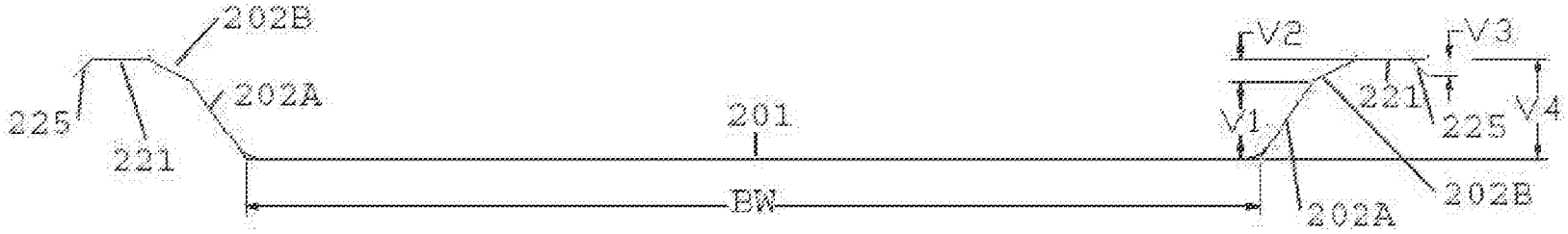
FIG. 13 is a diagrammatic sectional side view of the paperboard plate along a line perpendicular to the line A-A shown in FIG. 11.
Figure 14:
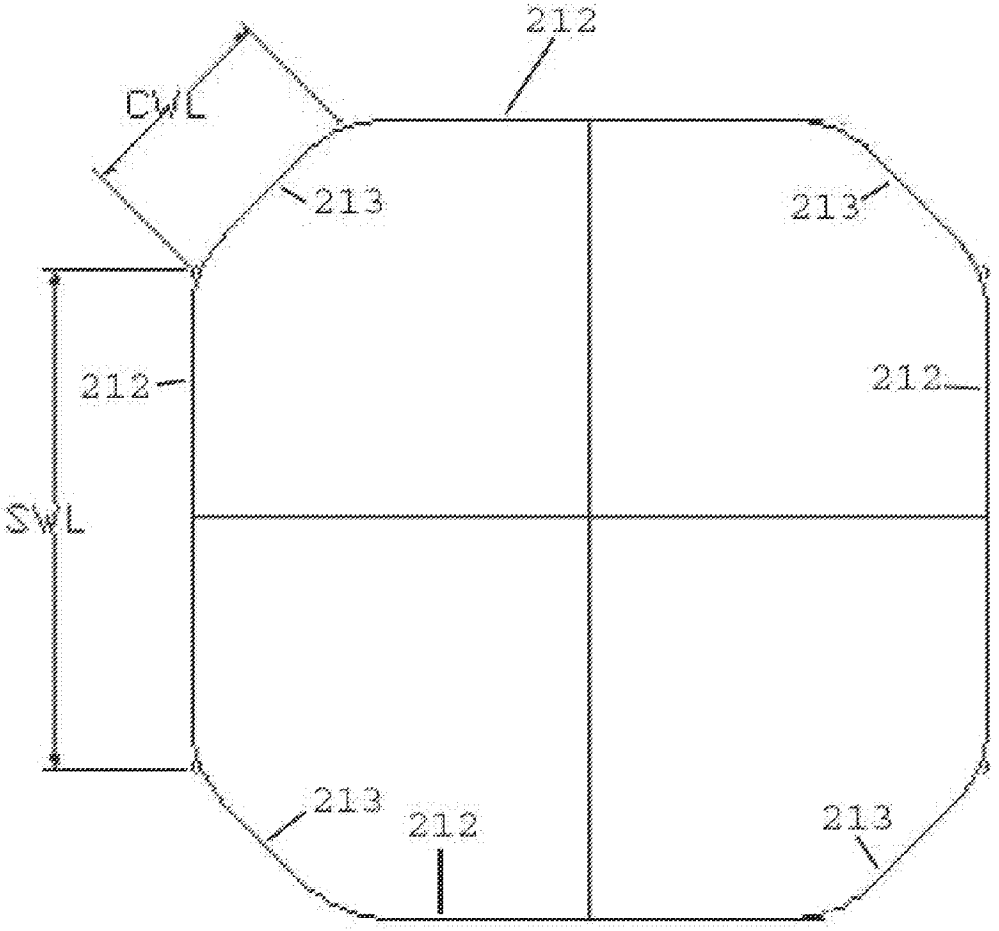
FIG. 14 is a diagrammatic top view of the paperboard plate shown in FIG. 10 to depict side wall upper edges and corner wall upper edges.

In accordance with another aspect of the disclosed subject matter, one or more of the side walls of the paperboard plate as previously described can include a lower portion and an upper portion. As embodied herein, and as shown in FIGS. 10 through 18, the lower portion of each side wall can be substantially planar and the upper portion of each side wall can be substantially planar. With reference to FIGS. 10 through 18, the paperboard plate 200 includes a base 201, a plurality of side walls 202, and a plurality of corner walls 203. The base 201 is a substantially smooth flat surface having an overall base length BL and an overall base width BW as shown in FIGS. 12 and 13. The plurality of side walls 202 extend upwardly from the base. Each side wall includes a substantially straight upper edge 212 at a height V4 from the base. The height V4 is less than about 0.20 times the base length BL. The plurality of corner walls 203 extend upwardly from the base 201. Each corner wall 203 is disposed between a pair of adjacent side walls 202 and includes a substantially straight upper edge 213 at the height V4 from the base, as illustrated in FIGS. 10 and 11. The upper edge 212 of each side wall 202 has a side wall upper edge length SWL as shown in FIG. 14. The upper edge 213 of each corner wall 203 has a corner wall upper edge length CWL, also shown in FIG. 14. The corner wall upper edge length CWL is less than each side wall length SWL.

For purpose of illustration and not limitation, the base length BL as embodied herein is substantially equal to the base width BW. As such, the side wall upper edge length SWL along base length BL is equal to the side wall upper edge length SWL along base width BW, and each corner wall upper edge length CWL is less than the side wall upper edge length SWL. Additionally or alternatively, the base 201 can include a crowned center portion 201A, as shown in FIGS. 10 and 11. The crowned center portion has a height up to about 0.05 times the greater of either the base length BL or the base width BW.

Figure 17:
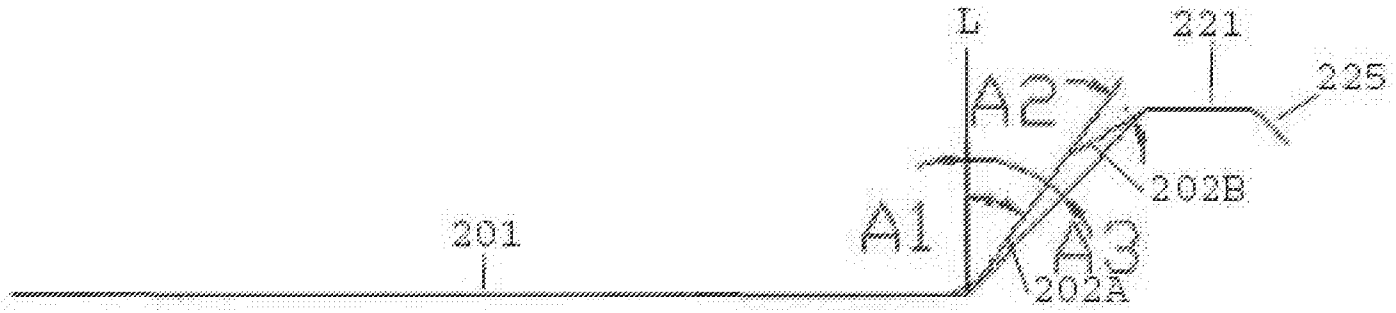
FIG. 17 is an enlarged diagrammatic sectional side view of a portion of the paperboard plate along the line A-A shown in FIG. 11 to depict various angles of the side walls.
Figure 14:
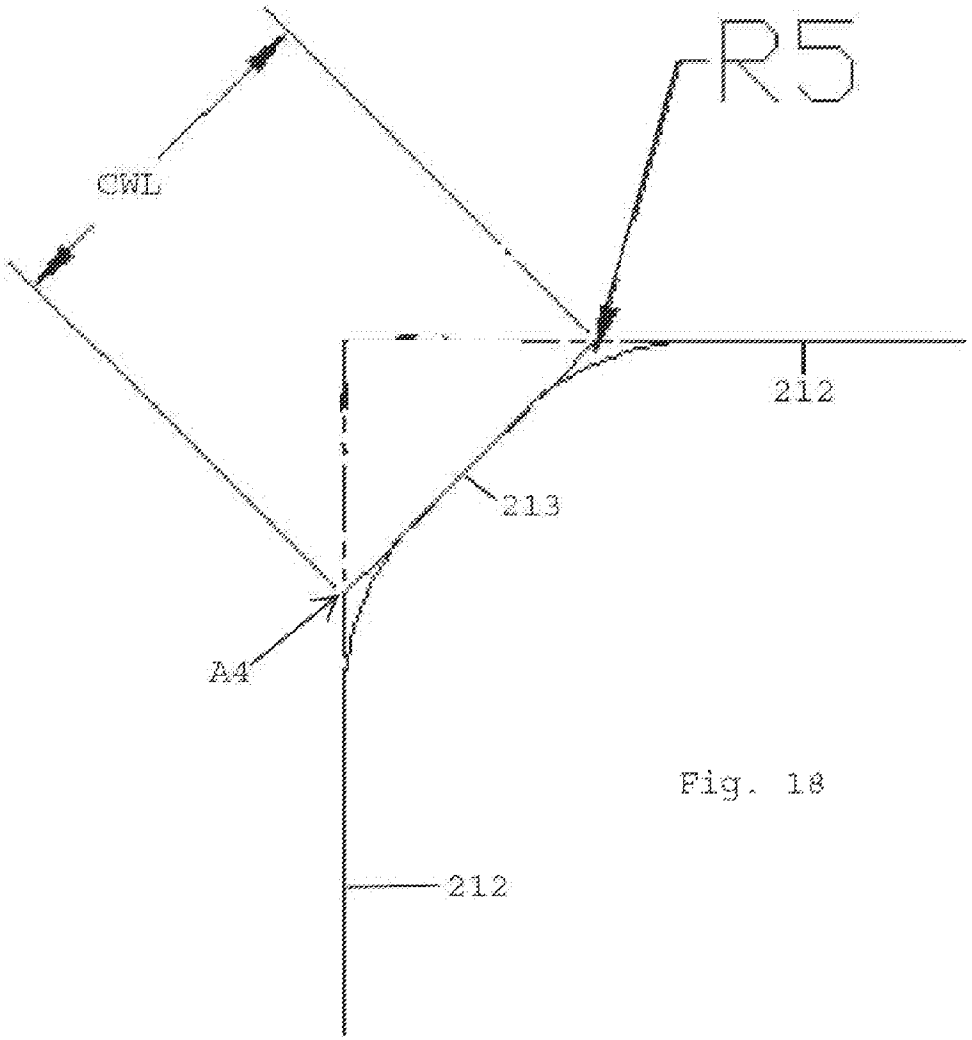

Each side wall 202 comprises a lower portion 202A and an upper portion 202B, as illustrated in FIGS. 10 and 11. The lower portion 202A of each side wall 202 is substantially planar and forms a first angle A1 with a line normal L to the base, as shown in FIG. 17. A sine of the first angle A1 is greater than about 0.05 times the base length BL. The upper portion 202B of each side wall 202 is substantially planar and forms a second angle A2 with a plane substantially parallel to the lower portion 202A of each side wall 202. A sine of the second angle A2 is greater than about 0.009 times the base length BL.

Figure 16:
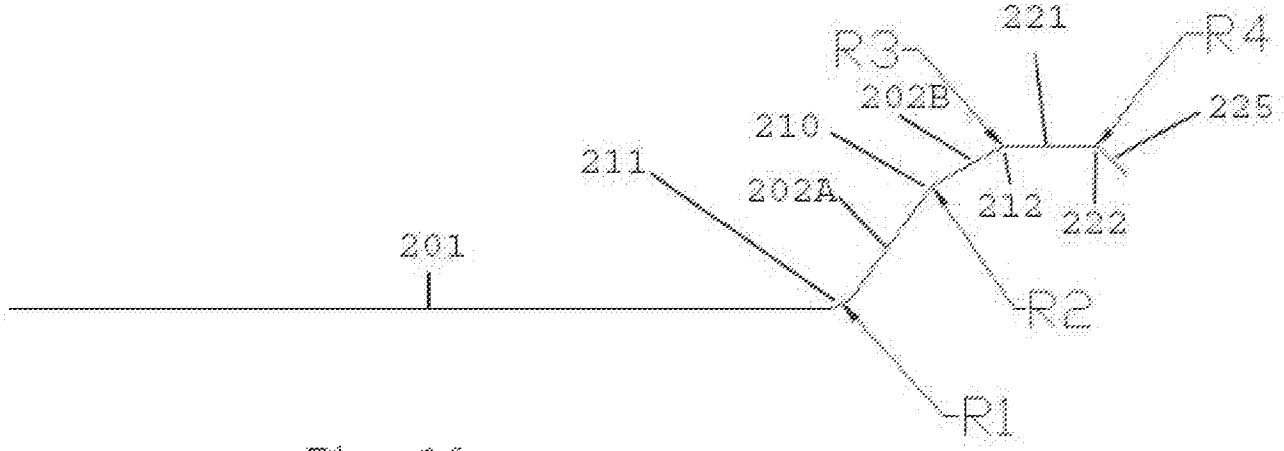
FIG. 16 is an enlarged diagrammatic sectional side view of a portion of the paperboard plate along the line A-A shown in FIG. 11 to depict various radii of curvature.

An inner top length ITL is defined between the upper edges 212 of opposing side walls 202 along the base length BL, as shown in FIG. 12. The lower portion 202A and the upper portion 202B of each side wall 202 define an interface 210 therebetween, as illustrated in FIGS. 10 and 11. The interface 210 therebetween the lower portion 202A and the upper portion 202B of each side wall has a cross-section with a radius of curvature R2 between about 0.001 and 0.05 times the inner top length ITL as shown in FIG. 16.

The lower portion 202A of each side wall 202 extends from the base 201 a height V1 above the base 201. The upper portion 202B extends from the interface 210 a distance V2 of about 0.1 up to about 1.0 times the height V4 as shown in FIG. 12. The distances V1 and V2 sum to equal the height V4.

An interface 211 is defined between the base 201 and each side wall 202. The interface 211 has a cross-section with a radius of curvature R1 between about 0.01 and 0.15 times the base length BL, as shown in FIG. 16. Each side wall 202 forms an overall resultant angle A3 with a line L normal to the base 201 as shown in FIG. 17. A sine of the resultant angle A3 is greater than about 0.05 times the base length BL.

Figure 15:
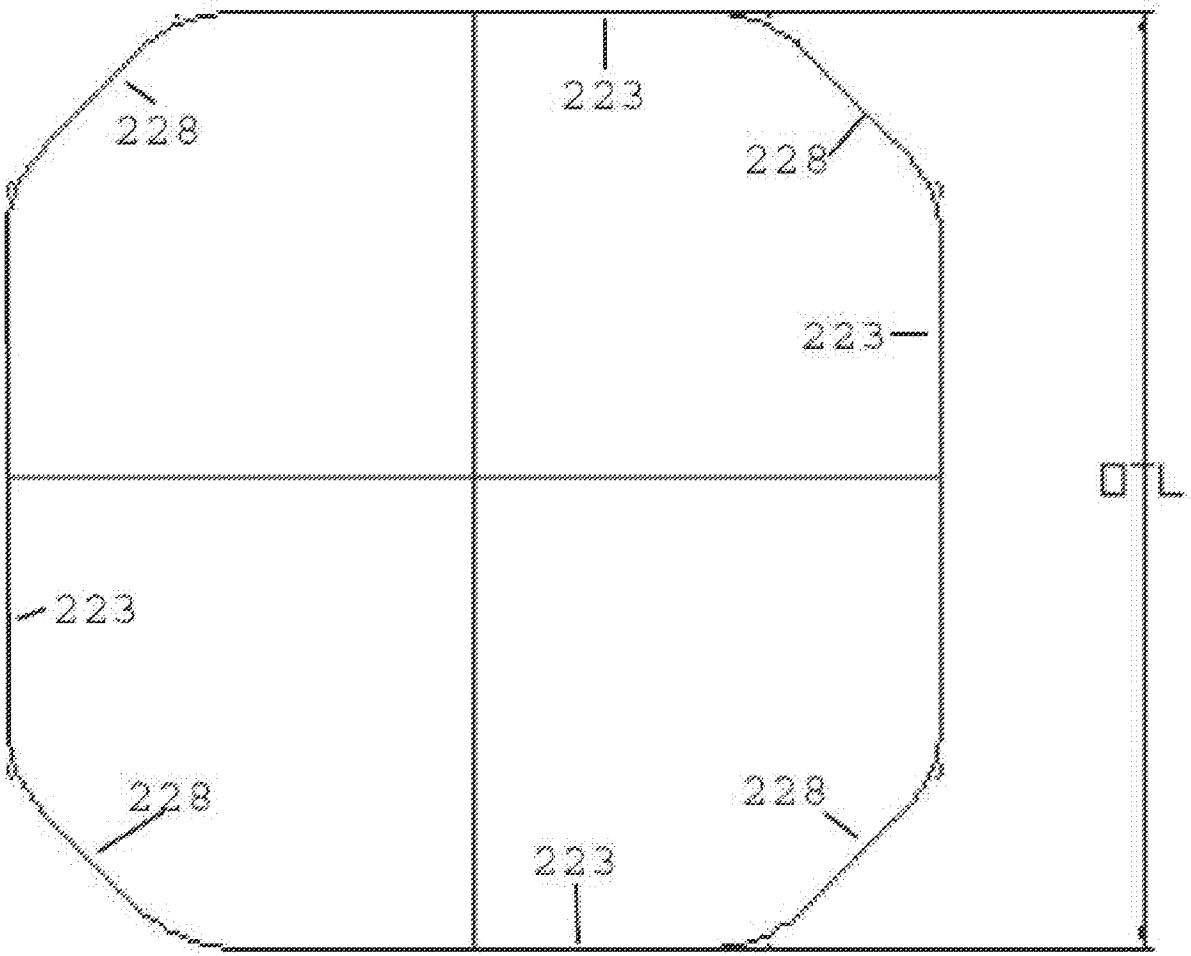
FIG. 15 is a diagrammatic top view of the paperboard plate shown in FIG. 10 to depict an outer perimeter of the paperboard plate.

A flange 221 extends from the upper edge 212 of each side wall 202, as illustrated in FIGS. 10 and 11. The flange 221 has an outer edge 223 opposite the upper edge 212 of each side wall 202. An outer top length OTL is defined between the outer edge 223 of the flange 221 on opposing side walls 212 along the base length BL as shown in FIG. 15. The upper edge 212 of each side wall 202 and the flange 221 extending therefrom define an interface 220 therebetween. The interface 220 therebetween the upper edge 212 of each side wall 202 and the flange 221 extending therefrom has a cross-section with a radius of curvature R3 between about 0.001 and 0.05 times the outer top length OTL as shown in FIG. 16. The flange 221 includes a turndown portion 225 along a central interface 222 thereof, wherein turndown portion 225 extends from central interface 222 to outer edge 223 of flange 221, as illustrated in FIGS. 10 and 11. The turndown portion 225 extends below the height V4 of the upper edge 212 a vertical distance V3 greater than about 0.001 times the outer top length OTL as shown in FIG. 12. The width F1 of flange 221 between upper edge 212 of side wall 202 and central interface 222 is less than about 0.1 times the outer top length OTL. The central interface 222 of the flange 221 has a cross-section with a radius of curvature R4 between about 0.001 and 0.050 times the outer top length OTL, as shown in FIG. 16.

Each corner wall upper edge length CWL is between about 0.04 and 0.41 times the OTL. A flange 227 extends from the upper edge 213 of each corner wall 203, as illustrated in FIGS. 10 and 11. The flange 227 extending from each corner wall 203 has an outer edge 228 opposite the upper edge 213 of each corner wall 203. The outer edge 228 of the flange 227 extending from each corner wall 203 transitions to the outer edge 223 of the flange 221 of an adjacent side wall 202 along a radius R5 between about 0.04 and 0.67 times the corner wall upper edge length CWL, as shown in FIG. 18.

Each of the embodiments disclosed above and variations thereof can include, but is not limited to, further modifications to include suitable features as desired. For example, each side wall upper edge length SWL can be at least about 2.5 times the height H. Each side wall upper edge and an adjacent corner wall upper edge can define an angle A4 of about 135 degrees as projected to a plane substantially parallel to the planar base and shown in FIGS. 9 and 18. Furthermore, each corner wall can be triangular or trapezoidal in shape, and each corner wall can have two or more portions of different inclination as previously described with regard to the side walls.

The paperboard plate as disclosed herein has advantages over other conventional plates in the art. For example, by placing a corner wall perpendicular to or near perpendicular to a diagonal center line of the base, the corner wall can aid in resisting the tendency of square or rectangular plates to twist and fold along the diagonal of the plate. Additionally, the substantially flat surface of the planar base increases the surface available for foodstuff and reduces the likelihood of creating an entry point for liquids through tearing or stretching of a liquid-repellent overcoat during manufacture of the paperboard plates. Further, a finite element analysis of the paperboard plates and comparable paperboard plates of varying design demonstrates that decreasing the cross sectional radii of curvature R3 and R4 at interfaces along the top of a plate increases the deflection strength of the plate. Further still, the turndown portion of the flange provides added hoop strength to the paperboard plate. Moreover, when the side walls are provided with a lower portion and an upper portion, the volume and surface area of the eating surface increases, as does the strength relative to comparable paperboard plates of varying design.

Figure 19:
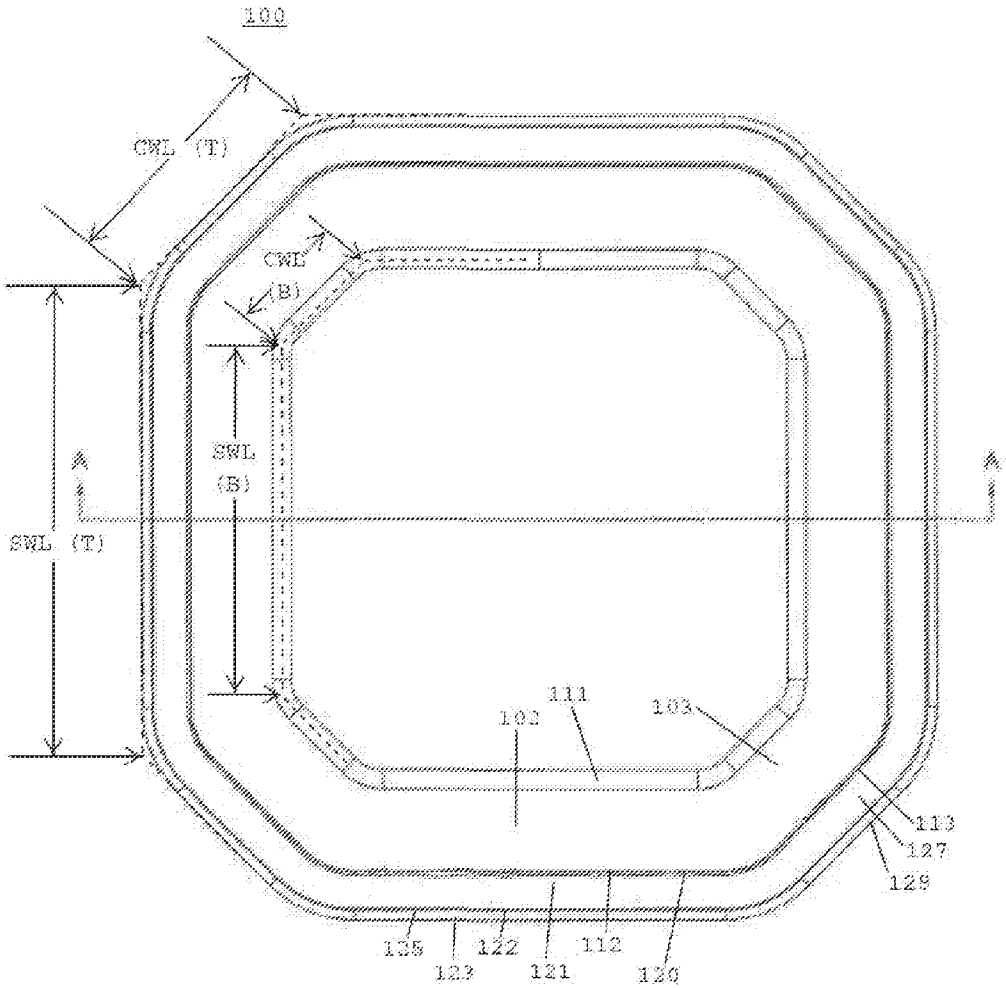
FIG. 19 is a top view of the paperboard plate shown in FIG. 1, depicting additional dimensions from Table 1.

For purpose of explanation and illustration, and not limitation, the dimensions of additional exemplary embodiments of the paperboard plate in accordance with the disclosed subject matter are set forth in Table 1. Table 1 illustrates, as non-limiting examples, the dimensional characteristics of six paperboard plates, labeled Embodiment A thru Embodiment E, which embody various combinations of the features disclosed herein. Dimensions as represented in Table 1 are depicted in FIG. 19, or as otherwise defined herein.

TABLE 1

| | Exemplary Embodiments (inches, unless indicated otherwise) | | | | |
|---|---|---|---|---|---|
| Dimension | Embodiment A | Embodiment B | Embodiment C | Embodiment D | Embodiment E |
| BL | 6.75 | 5.38 | 7.47 | 7.09 | 5.41 |
| BW | 6.75 | 5.38 | 7.47 | 7.09 | 5.41 |
| SWL | 5.66 | 4.48 | 5.71 | 5.54 | 4.39 |
| SWL (B) | 4.63 | 3.75 | 5.35 | 4.97 | 3.99 |
| SWL (T) | 6.13 | 4.84 | 6.17 | 6.02 | 4.81 |
| CWL | 2.53 | 1.88 | 2.24 | 2.082 | 1.40 |
| CWL (B) | 1.50 | 1.15 | 1.50 | 1.50 | 1.00 |
| CWL (T) | 3.00 | 2.24 | 2.71 | 2.55 | 1.82 |
| A1 | — | — | 35° | 35° | 35° |
| A2 | — | — | 60° | 60° | 60° |
| A3 | 60° | 60° | 45° | 45° | 45° |
| A4 | 135.0° | 135.0° | 135.0° | 135.0° | 135.0° |
| OTL | 10.38 | 8.00 | 10.00 | 9.63 | 7.38 |
| ITL | 9.25 | 7.13 | 8.88 | 8.5 | 6.38 |
| F1 | 0.44 | 0.31 | 0.44 | 0.44 | 0.31 |
| V1 | — | — | 0.56 | 0.16 | 0.16 |
| V2 | — | — | 0.19 | 0.19 | 0.13 |
| V3 | 0.15 | 0.15 | 0.15 | 0.15 | 0.15 |
| V4 | 0.75 | 0.44 | 0.75 | 0.34 | 0.28 |
| R1 | 0.50 | 0.50 | 0.25 | 0.25 | 0.25 |
| R2 | — | — | 0.02 | 0.02 | 0.02 |
| R3 | 0.02 | 0.02 | 0.02 | 0.02 | 0.02 |
| R4 | 0.03 | 0.03 | 0.03 | 0.02 | 0.02 |
| R5 | 1.00 | 1.00 | 1.33 | 1.33 | 1.11 |

In accordance with another aspect of the disclosed subject matter, the paperboard plate can have a rigidity measured by the industry standard Foodservice Packaging Institute rigidity system to be greater than 450 grams, and preferably greater than 500 grams. FPI Rigidity is expressed in grams of force per 0.5" deflection and is measured with the Foodservice Packaging Institute Plate Rigidity Tester of the type originally available through Foodservice Packaging Institute, 150 S. Washington Street, Suite 204, Falls Church, Va. 22046. The FPI rigidity test apparatus has been manufactured and sold through Peerless Machine & Tool Corporation, Marion, Ind. The FPI Rigidity test is designed to measure the rigidity (i.e., resistance to buckling and bending) of paper and plastic plates, bowls, dishes, and trays by measuring the force required to deflect the rim of these products a distance of 0.5" while the product is supported at its geometric center. The plate specimen is restrained by an adjustable bar on one side and is center supported. The rim or flange side opposite to the restrained side is subjected to 0.5" deflection by a motorized cam assembly equipped with a load cell, and the force (grams) is recorded. The test simulates in many respects the performance of a container as it is held in the hand of a consumer, supporting the weight of the container's contents. FPI rigidity is expressed as grams per 0.5" deflection. A higher FPI value is desirable since this indicates a more rigid product.

For purpose of demonstration and comparison, plates of the disclosed subject matter were evaluated for FPI Rigidity. Particularly, plates corresponding to Embodiment C in Table 1, were formed at tool temperatures ranging from 250 degrees F. to 400 degrees F. and forming pressures ranging from 1.8 tons to 10.0 tons with tool dwell times ranging from 1 second to 10 seconds.

The particular apparatus employed for FPI rigidity measurements was a Model No. FPI-2009-20 calibration gauge made by Peerless Machine Tool, 1804 West Second Street, Marion, Ind. 46952, using three deflection standards with the following deflection ranges: a) 215.1-233.0, b) 227.6-246.6, and c) 399.3-432.6. All testing was performed at ambient room conditions in Columbus, Ohio, with standard office air conditioning systems; temperature and percent relative humidity were recorded for each test.

Figure 20:
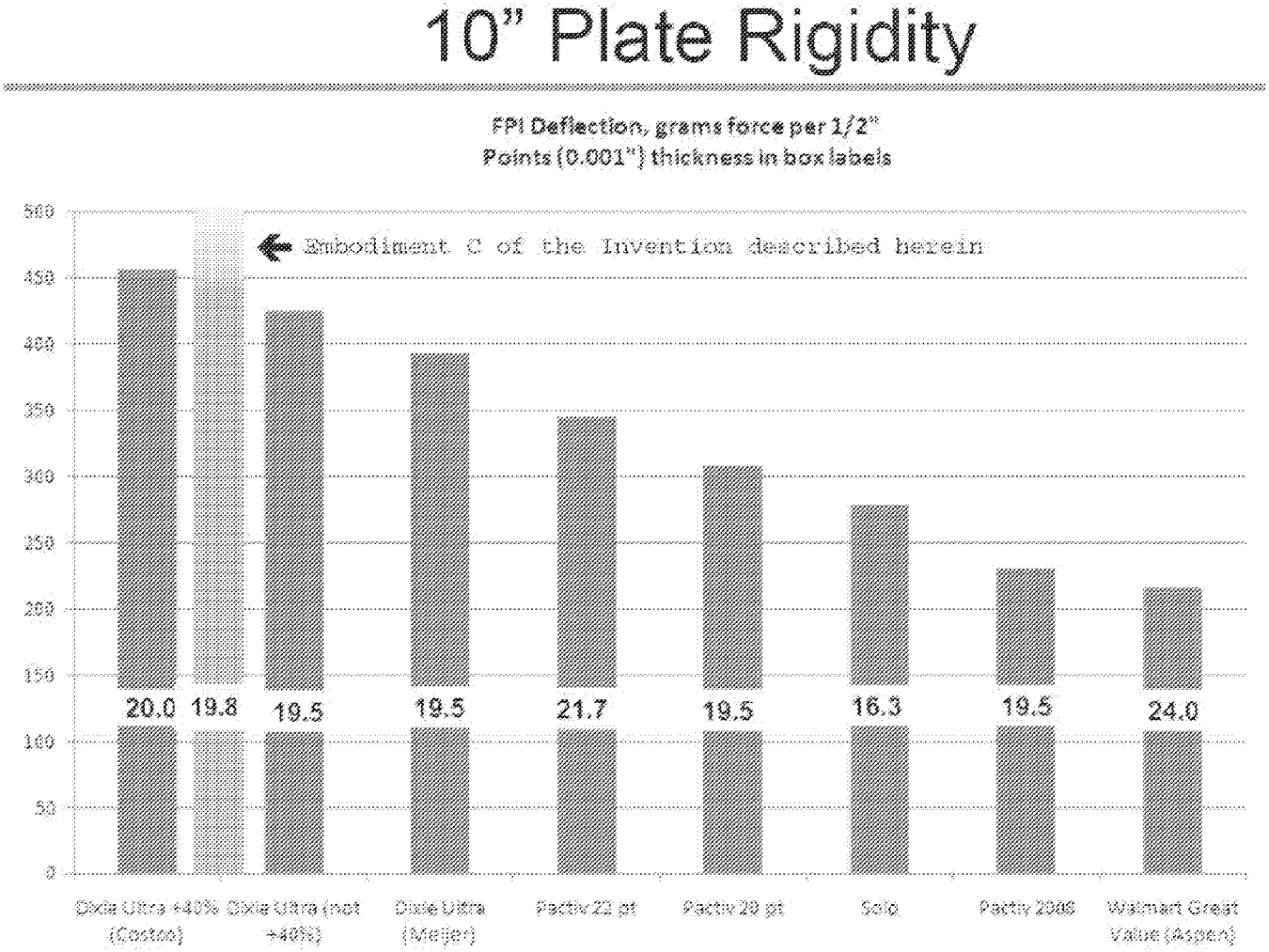
FIG. 20 is a graph depicting the results of FPI rigidity measurements on various commercially available plates as compared to paperboard plates of the disclosed subject matter.

Based on at least one sampling of tests, consisting of a series of 20 tests using the Foodservice Packaging Institute Plate Rigidity Tester, the mean FPI rigidity of the Embodiment C plate was determined to be 525.7 grams of force per 0.5" deflection with a standard deviation of about 8.1 grams of force per 0.5" deflection, wherein the paperboard plates were formed of 20 point, one side clay-coated solid bleached sulfate with a dwell time of 3 seconds under ten (10) tons of pressure while the top and bottom die tools were both held at 350 degrees F. These particular forming conditions and FPI rigidity values are for provided for the purpose of illustration and not limitation. FPI rigidity tests using the Foodservice Packaging Institute Plate Rigidity Tester were also performed on various commercially-available plates of alternative shapes and sizes for purpose of comparison with certain paperboard plates of the disclosed subject matter. Table 3 presents relevant data and results from these tests, and FIG. 21 graphically depicts the FPI deflection in grams force per ½", including the range of results on Embodiment C of the disclosed subject matter. The maximum mean FPI rigidities found for plates made as disclosed herein exceed the FPI rigidities of the comparative plates listed in Table 2 and FIG. 20.

TABLE 2

FPI Rigidity Test Results
Data Sorted in each Category by Rigidity Performance, high to low

| Item Category | Item Description | Item Code | Source | Package Count | Plate Weight Average (in.) | Plate Weight Std. Dev. (g) | Plate Gauge Average (points) | Plate Rigidity (FPI) Average (g-force) | Plate Rigidity (FPI) Std. Dev. (g-force) | Plate Rigidity (FPI) Variation (%) |
|---|---|---|---|---|---|---|---|---|---|---|
| 10" Plate | Dixie Ultra, 10 1/16" | 13 | Walmart | 40 | 21.51 | 0.09 | 19.8 | 487.8 | 27.0 | 5.5% |
| | Pactiv 22 pt | A | Pactiv | | 23.20 | 0.16 | 21.7 | 344.8 | 19.6 | 5.7% |
| | Pactiv 20 pt | B | Pactiv | | 20.60 | 0.20 | 19.5 | 308.8 | 17.0 | 5.5% |
| | Great Value 10" Ultra Strong (Columbus) | 12 | Walmart | 40 | 24.03 | 0.08 | 24.8 | 294.6 | 16.4 | 5.6% |
| | Dixie Heavy Duty, 10¼" | 14 | Meijer | 24 | 16.90 | 0.15 | 16.3 | 246.7 | 10.9 | 4.4% |
| | Great Value 10" Ultra Strong (Chicago) | 12-2 | Walmart | 40 | 23.97 | 0.07 | 23.5 | 161.3 | 7.9 | 4.9% |
| 9" Plate | Dixie Heavy Ultra, 8½" | 10 | Walmart | 60 | 14.93 | 0.16 | 18.7 | 453.3 | 39.5 | 8.7% |
| | Dixie Heavy Duty, 8⅝" | 6 | Walmart | 100 | 11.51 | 0.05 | 13.9 | 275.1 | 17.1 | 6.2% |
| | Pactiv 16 pt | C | Pactiv | | 13.33 | 0.05 | 15.5 | 236.3 | 10.6 | 4.5% |
| | Dixie Heavy Duty, 8⅝" | 9 | Walmart | 45 | 11.85 | 0.06 | 14.2 | 227.4 | 14.4 | 6.3% |
| | Great Value Heavy Duty 9" | 7 | Walmart | 45 | 11.41 | 0.04 | 14.3 | 130.8 | 6.1 | 4.7% |
| 7" Plate | Dixie Heavy Duty 6⅞" | 8 | Walmart | 48 | 7.03 | 0.05 | 13.0 | 239.8 | 29.8 | 12.4% |
| | Pactiv 14 pt | D | Pactiv | | 8.0 | 0.02 | 14.8 | 202.3 | 10.2 | 5.0% |

In addition to the specific embodiments and features disclosed herein, this application also incorporates by reference the entire disclosure of each and every patent publication identified herein. This application therefore includes any possible combination of the various features disclosed, incorporated by reference or claimed herein. As such, the particular features presented in the dependent claims and disclosed above can be combined with each other in other manners within the scope of the application such that the application should be recognized as also specifically directed to other embodiments having any other possible combinations. Thus, the foregoing description of specific embodiments of the application has been presented for purposes of illustration and description. It is not intended to be exhaustive or to limit the application to those embodiments disclosed.

The invention claimed is:

1. A paperboard plate comprising:

a base having a substantially smooth flat surface having an overall base length and an overall base width;

a plurality of side walls extending upwardly from the base, each side wall having a substantially straight upper edge at a height from the base, the height being less than about 0.20 times the base length; and a plurality of corner walls extending upwardly from the base, each corner wall disposed between a pair of adjacent side walls and having a substantially straight upper edge at the height from the base, the upper edge of each side wall having a side wall upper edge length, and the upper edge of each corner wall having a corner wall upper edge length less than each side wall length, wherein dimensions of the paperboard plate are selected to provide a rigidity measured by the industry standard Foodservice Packaging Institute rigidity system to be greater than about 450 grams.

2. The paperboard plate of claim 1, wherein the base length is substantially equal to the base width.

3. The paperboard plate of claim 1, wherein the base has a crowned center portion.

4. The paperboard plate of claim 3, wherein the crowned center portion has a height up to about 0.05 times the longer of base length and base width.

5. The paperboard plate of claim 1, wherein an interface is defined between the base and each side wall, the interface having a cross-section with a radius of curvature between about 0.01 and 0.15 times the base length.

6. The paperboard plate of claim 1, wherein each side wall comprises a lower portion and an upper portion.

7. The paperboard plate of claim 6, wherein the lower portion of each side wall is substantially planar and the upper portion of each side wall is substantially planar.

8. The paperboard plate of claim 6, wherein an inner top length is defined between the upper edge of opposing side walls along the base length, and further wherein the lower portion and the upper portion of each side wall define an interface therebetween having a cross-section with a radius of curvature R2 between about 0.001 and 0.050 times the inner top length.

9. The paperboard plate of claim 6, wherein the lower portion of each side wall extends from the planar base a height above the planar base, and the upper portion of each side wall extends from an interface between the lower portion and the upper portion a distance from about 0.1 up to about 1.0 times the side wall height.

10. The paperboard plate of claim 1, further comprising a flange extending from the upper edge of each side wall, wherein the flange has an outer edge opposite the upper edge of each side wall and the flange has a central interface between the upper edge of each side wall and the outer edge of the flange, and further wherein an outer top length is defined between the outer edge of the flange on opposing side walls along the base length.

11. The paperboard plate of claim 10, wherein the upper edge of each side wall and the flange extending therefrom define an interface therebetween having a cross-section with a radius of curvature R3 between about 0.001 and 0.05 times the outer top length.

12. The paperboard plate of claim 10, wherein a width of a portion of the flange between the upper edge of one of the plurality of side walls and the central interface is less than about 0.1 times the outer top length.

13. The paperboard plate of claim 10, wherein the flange includes a turndown portion along the central interface thereof, the turndown portion extending from the central interface to the outer edge of the flange.

14. The paperboard plate of claim 13, wherein the turndown portion extends below the height of the upper edge of each side wall a vertical distance greater than about 0.001 times the outer top length.

15. The paperboard plate of claim 13, wherein the central interface of the flange has a cross-section with a radius of curvature R4 between about 0.001 and 0.050 times the outer top length.

16. The paperboard plate of claim 10, wherein each corner wall upper edge length is between about 0.04 and 0.41 times the outer top length.

17. The paperboard plate of claim 10, further comprising a flange extending from the upper edge of each corner wall, wherein the flange extending from each corner wall has an outer edge opposite the upper edge of each corner wall, and further wherein the outer edge of the flange extending from each corner wall transitions to the outer edge of the flange of an adjacent side wall along a radius R5 between about 0.04 and 0.67 times the corner wall upper edge length.

18. The paperboard plate of claim 1, wherein each side wall upper edge length is at least about 2.5 times the side wall height.

19. The paperboard plate of claim 1, wherein each side wall is substantially planar and each corner wall is substantially planar.

20. The paperboard plate of claim 19, wherein each side wall and an adjacent corner wall define an angle of about 135 degrees as projected to a plane substantially parallel to the planar base.

21. The paperboard plate of claim 1, wherein the rigidity measured by the industry standard Foodservice Packaging Institute rigidity system is greater than 500 grams.

* * * * *